US007887285B2

(12) United States Patent
Fukuki et al.

(10) Patent No.: US 7,887,285 B2
(45) Date of Patent: Feb. 15, 2011

(54) PUMP AND FLUID SUPPLYING APPARATUS

(75) Inventors: Harumi Fukuki, Kasuga (JP); Motohiko Matsuguma, Tosu (JP); Toshisuke Sakai, Onojo (JP); Tetsuya Anami, Onojo (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 511 days.

(21) Appl. No.: 11/902,224

(22) Filed: Sep. 20, 2007

(65) Prior Publication Data

US 2008/0075586 A1 Mar. 27, 2008

(30) Foreign Application Priority Data

Sep. 22, 2006 (JP) ..... 2006-257961

(51) Int. Cl.
*F04D 1/04* (2006.01)
*F25B 1/00* (2006.01)

(52) U.S. Cl. ..... 415/55.2; 62/498

(58) Field of Classification Search ..... 62/478, 62/498; 415/113, 121.2, 55.2; 416/185, 416/186; 417/81, 353
See application file for complete search history.

(56) References Cited

U.S. PATENT DOCUMENTS 4,936,744 A * 6/1990 Dosch et al. ..... 415/169.1
5,149,253 A * 9/1992 Miyamoto et al. ..... 417/353
5,402,023 A * 3/1995 Nakanishi et al. ..... 310/90
6,663,362 B1 12/2003 Lentz et al.
6,752,597 B2 * 6/2004 Pacello et al. ..... 416/186 R
6,808,371 B2 * 10/2004 Niwatsukino et al. ..... 417/353
2004/0136825 A1 * 7/2004 Addie et al. ..... 415/121.2
2008/0075586 A1 * 3/2008 Fukuki et al. ..... 415/177

FOREIGN PATENT DOCUMENTS

JP 52-056401 5/1977
JP 63-034390 3/1988
JP 64-044399 3/1989
JP 2001041193 A * 2/2001
JP 2001-065484 3/2001
JP 2003-515059 4/2003
JP 2004-011525 1/2004
JP 2004-285888 10/2004

* cited by examiner

*Primary Examiner*—Frantz F Jules
*Assistant Examiner*—Emmanuel Duke
(74) *Attorney, Agent, or Firm*—Bacon & Thomas, PLLC

(57) ABSTRACT

A pump includes a rotatable rotor installed in a motor part and at least one impeller installed in a pump part, capable of being rotated together with the rotor in unison. The rotor and the impeller are accommodated in a casing, and the impeller has an inlet at an inner periphery thereof and an outlet at an outer periphery thereof. A housing is arranged in both sides of an axial direction of the impeller and has an outer peripheral part coupled to the rotor at a rear side portion thereof, and the outer peripheral part is projected outwards further than a gap between an outer peripheral surface of the rotor and an inner peripheral surface of the casing in which the rotor is rotatably accommodated.

12 Claims, 4 Drawing Sheets

PUMP AND FLUID SUPPLYING APPARATUS

FIELD OF THE INVENTION

The present invention relates to a pump and a fluid supplying apparatus; and, more particularly, a pump operated by a motor to suck and discharge fluid, and a fluid supplying apparatus having the pump.

BACKGROUND OF THE INVENTION

Recently, as an example of low flow high head pump demanded in the market, a centrifugal pump in which impellers are provided in a multi-stage arrangement along a coaxial rotating shaft is being used to achieve a high head without increasing an outer diameter of the pump (see, for example, Patent Document 1).

In this configuration, energy is delivered to liquid by the impellers when the liquid is drawn sequentially into each of the impellers that are installed in the multi-stage arrangement. Thus, the discharging pressure is increased to achieve a high-head pumping.

(Patent Document 1)

Japanese Patent Application Publication No. 2001-65484

However, the above-described centrifugal pump is configured such that liquid drawn via an inlet port is discharged outwardly by a centrifugal force generated by a rotation of each of the impellers. Therefore, to increase the discharging pressure, it is necessary to minimize the leak of liquid that discharges from outlet ports of the impellers.

However, in the conventional centrifugal pump configured such that the impellers and a rotor in a motor part having permanent magnets are rotated together about a rotation support shaft installed in a casing, a gap exists between the casing and an outer peripheral side of the rotor. Therefore, a high pressure fluid discharged from the impellers may leak through the gap to thereby increase a loss of the fluid due to the leakage.

SUMMARY OF THE INVENTION

In view of the above, the present invention is configured to reduce a leakage loss of a high pressure fluid discharged from an outlet of an impeller.

In accordance with one aspect of the present invention, there is provided a pump including a rotatable rotor installed in a motor part; and at least one impeller installed in a pump part, capable of being rotated together with the rotor in unison. Here, the rotor and the impeller are accommodated in a casing, and the impeller has an inlet at an inner periphery thereof and an outlet at an outer periphery thereof. Further, a housing is arranged in both sides of an axial direction of the impeller and has an outer peripheral part coupled to the rotor at a rear side portion thereof, and the outer peripheral part is projected outwards further than a gap between an outer peripheral surface of the rotor and an inner peripheral surface of the casing in which the rotor is rotatably accommodated.

In a pump as configured above, the outer peripheral part of the rear side portion of the housing, which is adjacent to the outlet of the impeller, is projected outwards. Thus, fluid discharged from the outlet of the impeller can be suppressed from leaking through the gap between an outer peripheral surface of the rotor and an inner peripheral surface of the casing, thereby reducing leakage loss of the fluid in the pump.

It is preferable that the outer peripheral part is inserted in a recessed portion formed at the inner peripheral surface of the casing.

With this configuration, the projected outer peripheral part of the rear side portion of the housing is inserted into a recessed portion formed at the inner peripheral surface of the casing. Thus, fluid discharged from the outlet of the impeller can be further suppressed from leaking through the gap between an outer peripheral surface of the rotor and an inner peripheral surface of the casing.

Further, it is preferable that protrusions protruding in directions facing each other are formed on mutually facing surfaces of the outer peripheral part and the recessed portion, respectively, such that the protrusions are arranged not to overlap with each other in a plane including a rotating axis of the impeller. Here, a leading end of each protrusion of one side is located closer to a base part of each protrusion of the other side than a leading end of each protrusion of the other side is located.

With this configuration, by the presence of the protrusions formed on the mutually facing surfaces of the outer peripheral part and the recessed portion, fluid discharged from the outlet of the impeller can be further suppressed from leaking through the gap between an outer peripheral surface of the rotor and an inner peripheral surface of the casing.

Further, it is preferable that the protrusions of either the outer peripheral part or the recessed portion are two in number and spaced apart from each other in a radial direction of the impeller, wherein the remaining protrusion other than the two protrusions of either the outer peripheral part or the recessed portion is inserted in a groove formed between the two protrusions of either the outer peripheral part or the recessed portion.

With this configuration, the remaining protrusion is inserted in the groove formed between the two protrusions. Thus, fluid discharged from the outlet of the impeller can be further suppressed from leaking through the gap between an outer peripheral surface of the rotor and an inner peripheral surface of the casing.

Further, it is preferable that the impeller includes a bearing integrated therewith capable of being rotated about a rotating support shaft installed in the casing such that an axial end portion of the bearing is capable of being slidingly rotated with respect to the casing, wherein a dynamic pressure generation part that generates a dynamic pressure by a rotation of the impeller is formed on at least one of a first surface of the outer peripheral part that faces towards the bearing and a second surface of the recessed portion that faces the first surface in an axial direction.

With this configuration, due to the dynamic pressure generated by the rotation of the impeller, the bearing attached to the impeller is imposed by a force in a direction opposite to the casing that slidingly contacts the axial end portion of the bearing, so that a contact resistance between the contacting surfaces can be reduced. Therefore, an abrasive amount of contacting surfaces between the bearing and the casing can be reduced. Thus, the impeller cab be rotated at a high speed, and the efficiency and the lifetime of the pump can be improved.

Further, it is preferable that the dynamic pressure generation part includes at least one stepped portion that extends in a radial direction of the impeller.

With this configuration, by the presence of the stepped portion, the dynamic pressure can be generated with a higher reliability.

In accordance with another aspect of the present invention, there is provided a fluid supplying apparatus including the pump configured as described above.

With this configuration, by using the pump capable of reducing a leakage loss of fluid, the reliability of the fluid supplying apparatus can be enhanced.

If is preferable that the fluid supplying apparatus further includes a heat sink for cooling a heat generation compartment by drawing fluid discharged from the pump to the heat generation compartment; and a heat radiator for cooling the fluid whose temperature has been increased by gaining heat from the heat generation compartment at the heat sink, and supplying the cooled fluid into the pump.

With this configuration, by using the pump capable of reducing a leakage loss of fluid, the efficiency of cooling the heat generation compartment by the heat sink can be improved.

BRIEF DESCRIPTION OF THE DRAWINGS

The objects and features of the present invention will become apparent from the following description of embodiments given in conjunction with the accompanying drawings, in which.

DETAILED DESCRIPTION OF THE EMBODIMENTS

Hereinafter, embodiments of the present invention will be described with reference to the accompanying drawings which form a part hereof.

First Embodiment

Figure 1:
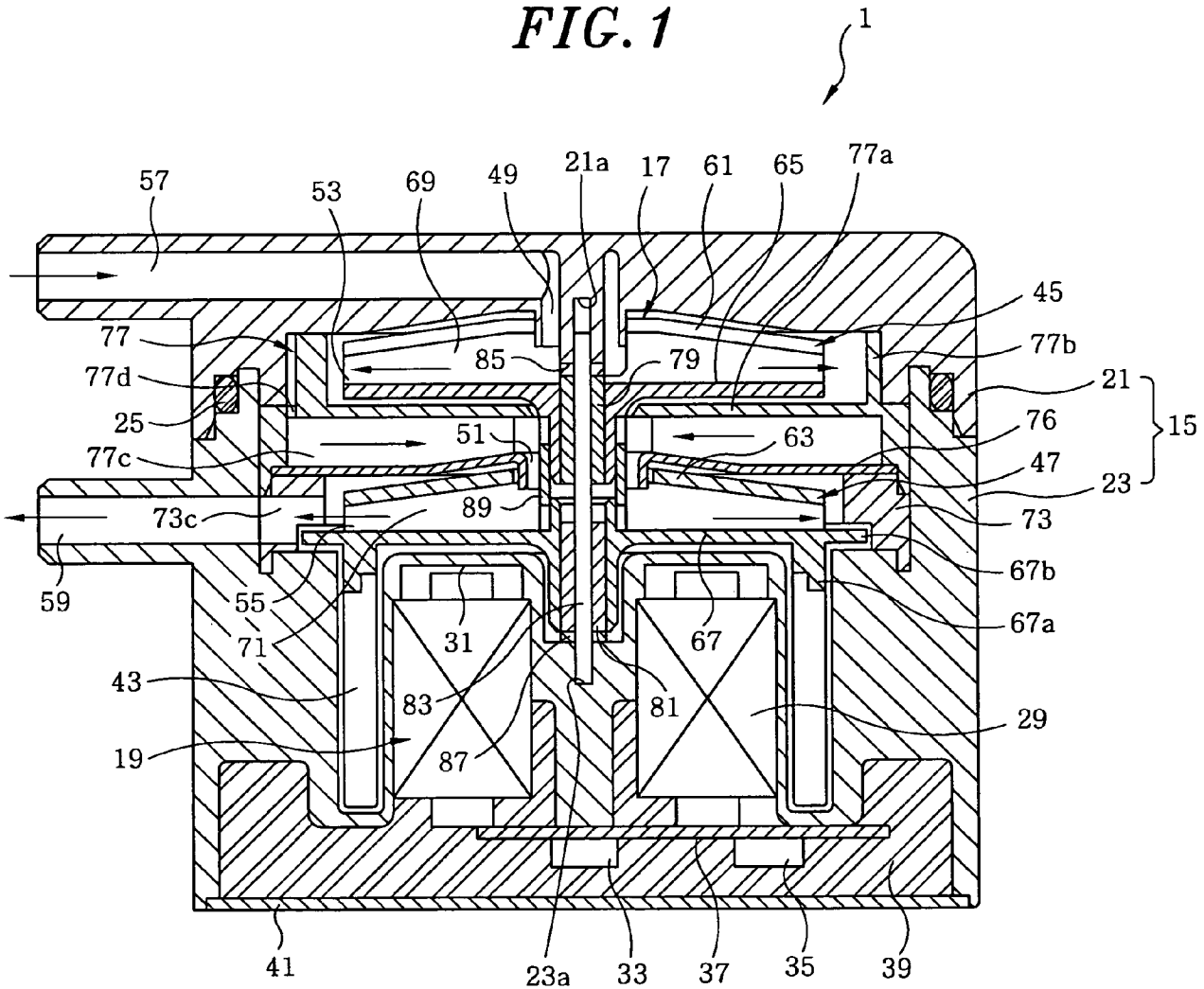
FIG. 1 is a cross sectional view of a pump in accordance with a first embodiment of the present invention.

FIG. 1 is a cross sectional view of a pump 1 according to a first embodiment of the present invention. The pump 1 is used in the fluid supplying apparatus shown in FIG. 2.

Figure 2:
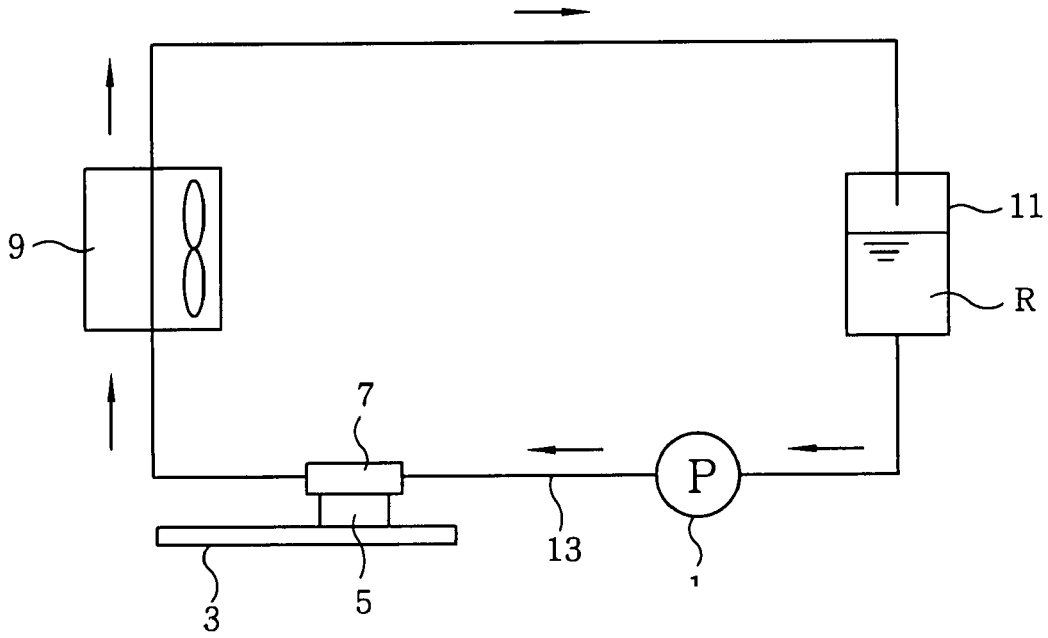
FIG. 2 is a schematic configuration view of a fluid supplying apparatus using the pump of FIG. 1.

The fluid supplying apparatus shown in FIG. 2 includes the pump 1; a board 3; a heat generation compartment 5 configured by electronic components and the like installed on a board 3; and a heat sink 7 that cools the heat generation compartment 5 through a heat exchange by using a liquid serving as a coolant discharged from the pump 1. The fluid supplying apparatus further includes a heat radiator 9 which cools liquid whose temperature has been increased by heat transferred from the heat generation compartment 5 to the heat sink 7; and a reserve tank 11 which stores therein liquid R discharged from the heat radiator 9. Here, the pump 1, the heat sink 7, the heat radiator 9 and the reserve tank 11 are connected in series via a piping 13.

As shown in FIG. 1, the pump 1 includes a pump part 17 disposed in a casing 15 at an upper part thereof; and a motor part 19 disposed in the casing 15 at a lower part thereof, wherein "upper" and "lower" are defined as seen in FIG. 1. The casing 15 includes a pump-side casing 21 and a motor-side casing 23, which are coupled to each other via a sealing member 25 interposed therebetween. The pump-side casing 21 is made of plastic such as polyphenylene sulfide (PPS) or metal such as stainless steel. Further, the motor-side casing 23 is made of metal such as aluminum or heat resistant plastic.

The motor-side casing 23 serves to isolate the motor part 19 from the pump part 17 to prevent the liquid R from coming into the motor part 19 from the pump part 17.

The motor part 19, arranged in the motor-side casing 23, includes a cylindrical stator 29 which generates a magnetic field by an electric conduction therethrough. The stator 29 is fixed in a stator accommodating portion 31 that is provided in the motor-side casing 23 and has a opened area at a lower side thereof, wherein "lower" is defined as seen in FIG. 1.

A circuit board 37, which includes a control unit provided with electronic components 33 and 35 (such as a transformer, a transistor and/or the like) for controlling an electric conduction through the stator 29, is attached to the motor-side casing 23 such that the circuit board 37 covers a part of the stator accommodating portion 31.

Further, a part of the motor-side casing 23 opened downwards in FIG. 1 is filled with a resin 39 injected and hardened therein for protecting the stator 29 and the control unit having the electronic components 33 and 35. In addition, the part of the motor-side casing 23 opened downwards and filled with the resin 39 is tightly covered with a cover 41.

Adjacent to an outer periphery of the stator 29 in the motor part 19 is installed a cylindrical rotor 43 having a permanent magnet and the like, such that the rotor 43 can be rotated by the magnetic field generated by the stator 29.

Further, the pump part 17 includes a plurality of impellers (in the illustrated example, two impellers 45 and 47) arranged in an axial direction in a multi-stage arrangement, which are rotated together with the rotor 43 in unison. Each of the impellers 45 and 47 is substantially disk-shaped, and has an inlet 49 or 51 at an inner periphery thereof and an outlet 53 or 55 in an outer periphery thereof. Furthermore, each of the impellers 45 and 47 is made of, e.g., plastic such as PPS.

The inlet 49 of the impeller 45 that is upstream of the impeller 47 communicates with a casing inlet port 57 formed at an upper portion of the pump-side casing 21. On the other hand, the outlet 55 of the impeller 47 that is downstream of the impeller 45 communicates with a casing outlet port 59 formed at an upper portion of the motor-side casing 23.

Furthermore, the impellers 45 and 47 include front shrouds 61 and 63, respectively, and rear shrouds 65 and 67, respectively, wherein the front shrouds 61 and 63 and the rear shrouds 65 and 67 form a housing. Further, the impellers 45 and 47 are respectively provided with blades 69 between the front shroud 61 and the rear shroud 65 and blades 71 between the front shroud 63 and the rear shroud 67.

Thus, by the operation of the blades 69 or 71 pursuant to the rotation of the impeller 45 or 47, liquid drawn into the inlet 49 or 51 is pressure-driven out in an outwardly radial direction through the impeller 45 or 47 to be discharged via the outlet 53 or 55.

Further, a ring-shaped coupling protrusion 67*a* protrudes downwards from a lower side of a near-peripheral part of the rear shroud 67 of the downstream-side impeller 47, and an end portion of the coupling protrusion 67*a* is fixedly coupled to an upper end of the rotor 43 in the motor part 19.

Thus, in the present embodiment of the present invention, the impeller 47 in the pump part 17 and the rotor 43 in the motor part 19 are accommodated in the casing 15 in a manner that they can be rotated together in unison.

An outer diameter of the rear shroud 67 that forms a rear side of the downstream-side impeller 47 is greater than that of the front shroud 63 of the downstream-side impeller 47, whereby an outer peripheral part of the rear shroud 67 is projected outwards to form a projected end portion 67*b*. On the other hand, outer diameters of the front shroud 61 and the rear shroud 65 of the upstream-side impeller 45 are substantially equal to the outer diameter of the front shroud 63 of the downstream-side impeller 47.

Further, a ring-shaped member 73 is fixed to an inner peripheral surface of the motor-side casing 23 at a position corresponding to the projected end portion 67*b*, thereby forming a part of the motor-side casing 23. As shown in the enlarged view of FIG. 3, a ring-shaped cutoff portion 73*a* is formed at a lower part of an inner periphery of the ring-shaped member 73. A recessed portion 75 that is opened inwards is formed between the cutoff portion 73*a* and the motor-side casing 23.

Further, the projected end portion 67*b* of the rear shroud 67 is inserted into the recessed portion 75. Here, a gap S is formed between the outer peripheral surface of the rotor 43 and the inner peripheral surface of the motor-side casing 23 in which the rotor 43 is rotatably accommodated. The projected end portion 67*b* extends outwards beyond the gap S, thereby being surrounded by the recessed portion 75.

Further, the ring-shaped member 73 has an outlet passage 73*c*, which is formed at a position corresponding to the casing outlet port 59 in the motor-side casing 23. The outlet passage 73*c* communicates with the casing outlet port 59 such that liquid discharged from the outlet 55 of the downstream-side impeller 47 flows towards the casing outlet port 59 via the outlet passage 73*c*.

A disk-shaped partition plate 76, which is made of metal such as stainless steel is provided between the upstream-side impeller 45 and the downstream-side impeller 47 at a position closer to the downstream-side impeller 47, thereby partitioning between the impellers 45 and 47. The partition plate 76 is interposed to be fixed between a fluid guide member 77, which is disposed above the partition plate 76, and the ring-shaped member 73.

The fluid guide member 77 includes a disk-shaped part 77*a* disposed between the upstream-side impeller 45 and the downstream-side impeller 47 at a position closer to the upstream-side impeller 45; and a guide blade 77*b* extending upwards an upper side of an outer peripheral part of the disk-shaped part 77*a*. Further, a returning blade 77*c* is provided under the disk-shaped part 77*a*. The fluid guide member 77 is made of plastic such as PPS.

The guide blade 77*b* guides liquid discharged from the outlet 53 of the impeller 45 towards the outer peripheral part of the fluid guide member 77 to introduce the liquid into a space formed above the partition plate 76 via a communicating hole 77*d* formed in the outer peripheral end portion of the fluid guide member 77. Meanwhile, the returning blade 77*c* guides the liquid introduced into the space formed above the partition plate 76 towards the inlet 51 formed at the inner periphery of the impeller 47.

Further, bearings 79 and 81 made of sintered carbon or molded carbon are respectively provided at rotating centers of the upstream-side impeller 45 and the downstream-side impeller 47. A rotating support shaft 83 made of metal such as stainless steel is inserted into the bearings 79 and 81 to rotatably support the impellers 45 and 47. Here, an upper end part of the rotating support shaft 83 is inserted into a connection hole 21*a* of the pump-side casing 21, and a lower end part of the rotating support shaft 83 is inserted into a connection hole 23*a* of the motor-side casing 23.

Bearing plates 85 and 87, made of ceramic and penetrated by the rotating support shaft 83, are provided respectively between the upper end of the upper bearing 79 and the pump-side casing 21 and between the lower end of the lower bearing 81 and the motor-side casing 23 such that the bearing plates 85 and 87 contact the upper end of the bearing 79 and the lower end of the bearing 81, respectively.

Further, the upstream-side impeller 45 and the downstream-side impeller 47 are fixedly coupled to each other by means of a connecting member 89, so that the impellers 45 and 47 are rotated together in unison.

In the pump 1 configured as described above, the rotor 43 is rotated by the operation of the motor part 19, and the two impellers 45 and 47 are rotated together in unison by the rotation of the rotor 43. The liquid R, which has been contained in the reserve tank 11 of FIG. 2, is drawn into the casing inlet port 57 by the rotation of the impellers 45 and 47. Subsequently, the liquid R is introduced into the upstream-side impeller 45 via the inlet 49, and is forcibly driven towards the outer periphery of the impeller 45 by the plurality of blades 69. Thereafter, the liquid R passes through the communicating hole 77*d*, and flows inwards in the space between the impellers 45 and 47. Then, the liquid R is drawn into the downstream-side impeller 47 via the inlet 51.

The liquid R introduced into the impeller 47 is forcibly driven towards the outer periphery of the impeller 47 by the plurality of blades 71, and then is supplied into the piping 13 via the outlet 55 and the casing outlet port 59. Thereafter, the liquid R is drawn into the heat sink 7 of FIG. 2 to cool the heat generation compartment 5. The liquid R, whose temperature has been increased by cooling the heat generation compartment 5, flows to reach the heat radiator 9. After radiating heat at the heat radiator 9 to reduce its temperature, the liquid R is returned to the reserve tank 11.

Figure 3:
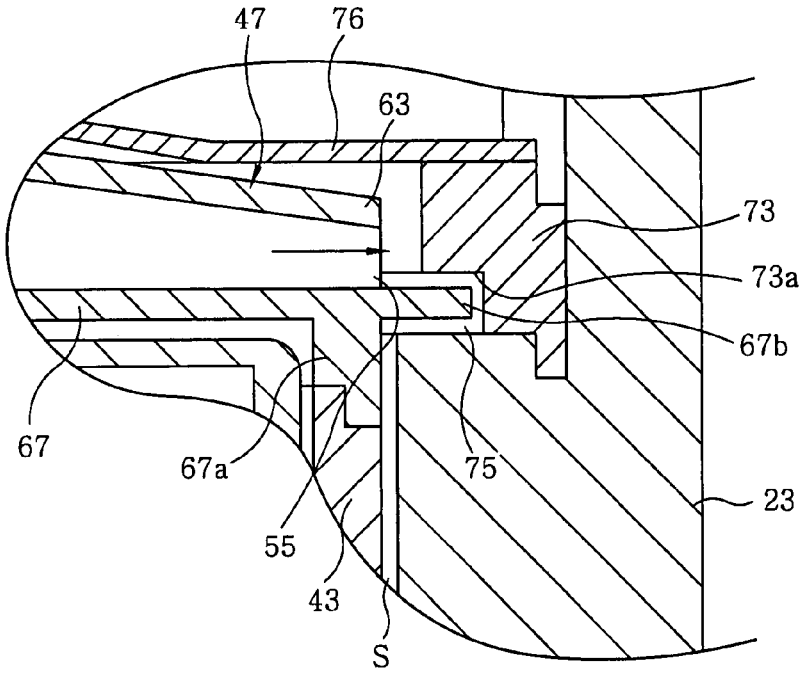
FIG. 3 is an enlarged cross sectional view of main parts of the pump shown in FIG. 1.

Here, as shown in FIG. 3 in detail, in the downstream-side impeller 47, the outer diameter of the rear shroud 67 is greater than that of the front shroud 63 such that the projected end portion 67*b* of the outer peripheral part of the rear shroud 67 is inserted into the recessed portion 75 formed between the motor-side casing 23 and the ring-shaped member 73. As such, the rear shroud 67 of the impeller 47 is designed such that the projected end portion 67*b* thereof is covered with the recessed portion 75.

Therefore, since the projected end portion 67*b* forms a shape in which it covers the gap S between the rotor 43 and the motor-side casing 23, a high pressure liquid discharged via the outlet 55 from the downstream-side impeller 47 can be suppressed from leaking through the gap S, thereby reducing a leakage loss of fluid. Therefore, a high efficiency of a high-head and low-flow-rate pump can be achieved while reducing a size thereof by arranging the impellers 45 and 47 in a coaxial structure.

Further, as shown in FIG. 2, since the heat generation compartment 5 is cooled down by the liquid discharged from the high-efficiency pump 1 whose leakage loss has been reduced, the cooling efficiency of the heat sink 7 can be enhanced. Thus, the reliability of the fluid supplying apparatus can be improved.

Second Embodiment

Figure 4:
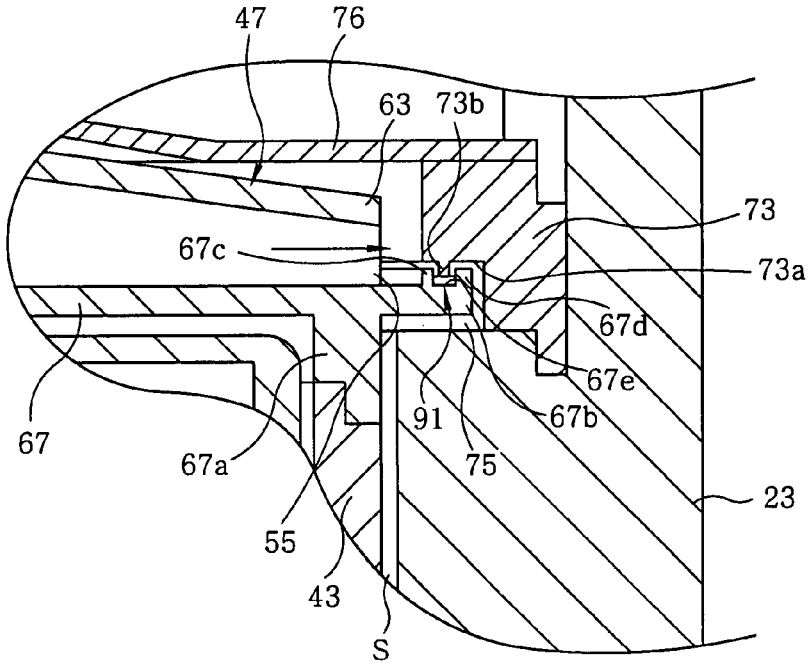
FIG. 4 is a cross sectional view of main parts of a pump in accordance with a second embodiment of the present invention.

FIG. 4 is a cross sectional view of main parts of a pump in accordance with a second embodiment of the present invention. The configuration of the second embodiment other than that shown in FIG. 4 is the same as that of the first embodiment shown in FIGS. 1 to 3, and the same reference characters are used to designate the same parts. In the second embodiment, a leakage prevention part 91 is provided between the projected end portion 67*b* of the rear shroud 67 of the downstream-side impeller 47 and the cutoff portion 73*a* of the ring-shaped member 73 that forms the recessed portion 75.

The leakage prevention part 91 includes ring-shaped lower protrusions 67*c* and 67*d*, which are provided on a surface of the projected end portion 67*b* that faces the impeller 45. The lower protrusions 67*c* and 67*d* are spaced apart from each other at a specific distance in a radial direction of the impeller 47. Further, a ring-shaped upper protrusion 73*b* is formed on a surface of the cutoff portion 73*a* that faces the ring-shaped lower protrusions 67*c* and 67*d*, and is positioned between the lower protrusions 67*c* and 67*d* so that the upper protrusion 73*b* is inserted into a ring-shaped groove 67*e* formed between the lower protrusions 67*c* and 67*d*.

That is, in the second embodiment, the ring-shaped lower protrusions 67*c* and 67*d* and the ring-shaped upper protrusion 73*b*, which protrude in directions facing each other, are formed on the mutually facing surfaces of the projected end portion 67*b* of the rear shroud 67 and the recessed portion 75 of the motor-side casing 23, respectively, such that the lower protrusions 67*c* and 67*d* and the upper protrusion 73*b* are arranged not to overlap with each other in a plane including the rotating axis of the impeller 47. Further, a leading end of each protrusion of one side (for example, each of the protrusions 67*c* and 67*d*) is located closer to a base part of each protrusion of the other side (for example, the protrusion 73*b*) than a leading end of each protrusion of the other side is located.

In the second embodiment configured as described above, the upper protrusion 73*b* formed on the ring-shaped member 73 is inserted into the ring-shaped groove 67*e* formed between the protrusions 67*c* and 67*d* formed on the projected end portion 67*b*. Thus, a high pressure liquid discharged from the outlet 55 of the downstream-side impeller 47 is more reliably prevented from leaking through the gap S, thereby further reducing a leakage loss of fluid compared to the second embodiment.

Further, the structure of the leakage prevention part 91 is not limited to that shown in FIG. 4. For example, in contrast with FIG. 4, two protrusions may be formed on the cutoff portion 73*a*, and one protrusion, which is inserted into a ring-shaped groove formed between the two protrusions, may be formed on the surface of the projected end portion 67*b* that faces the impeller 45. Further, one of the two protrusions 67*c* and 67*d* shown in FIG. 4 may be removed.

Alternatively, the leakage prevention part may be formed between an upper surface of the motor-side casing 23 within the recessed portion 75 and a surface of the projected end portion 67*b* opposite to the impeller 45 (i.e., a lower surface of the projected end portion 67*b* in FIG. 4). Further, the leakage prevention part may be formed between an end portion of an outer peripheral part of the projected end portion 67*b* (i.e., a right front end of the projected end portion 67*b* in FIG. 4) and a side of the cutoff portion 73*a* opposite thereto within the recessed portion 75.

Third Embodiment

Figure 5:
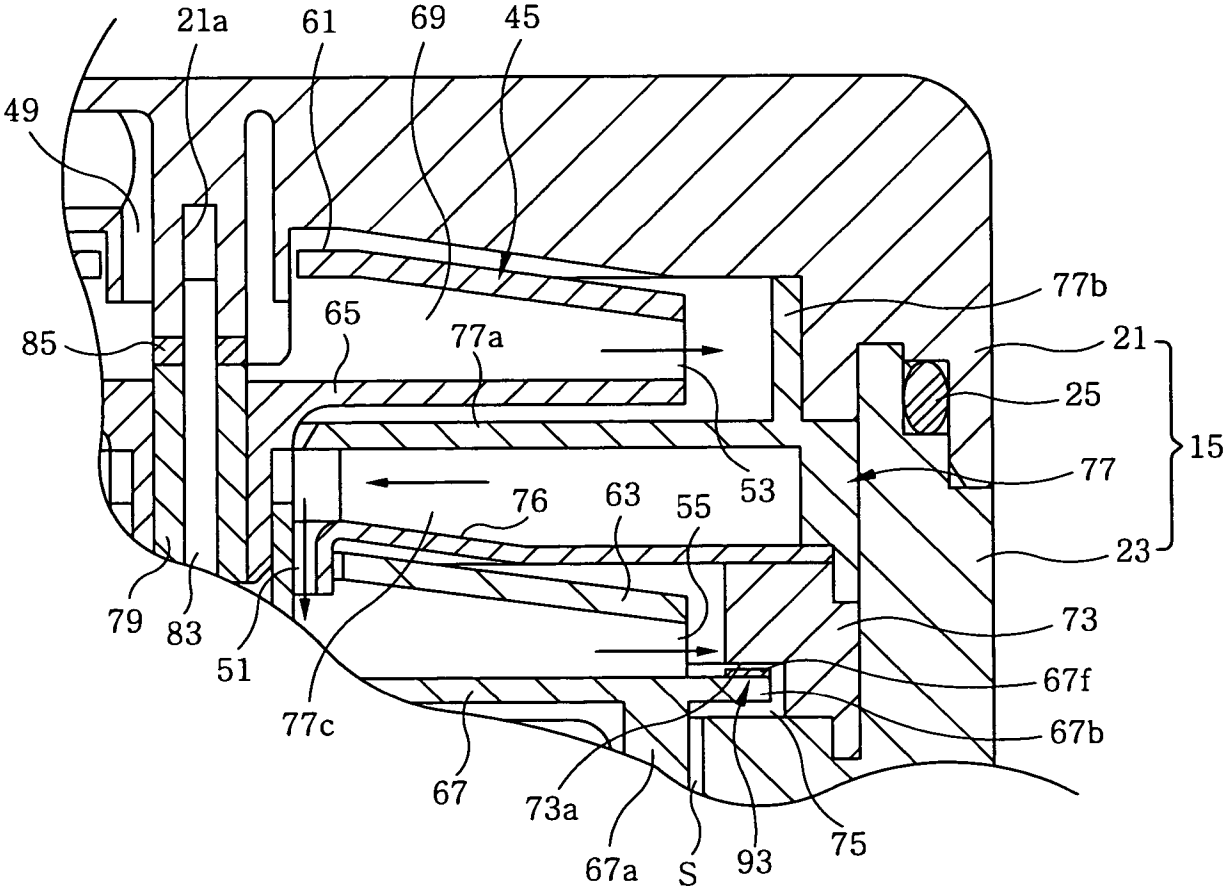
FIG. 5 is a cross sectional view of main parts of a pump in accordance with a third embodiment of the present invention.

FIG. 5 is a cross sectional view of main parts of a pump in accordance with a third embodiment of the present invention. The configuration of the third embodiment other than that shown in FIG. 5 is the same as that of the first embodiment shown in FIGS. 1 to 3, and the same reference characters are used to designate the same parts. In the third embodiment, a dynamic pressure generation part 93, which generates a dynamic pressure by the rotation of the downstream-side impeller 47, is provided on the projected end portion 67*b* of the rear shroud 67 of the downstream-side impeller 47.

The dynamic pressure generation part 93 includes stepped portions, i.e., a plurality of protrusions 67*f* protruding from a surface of the projected end portion 67*b* that faces the front shroud 63 of the impeller 47. Here, each of the protrusions 67*f* is elongated in a radial direction of the impeller 47.

Furthermore, as stepped portions, grooves may be formed in the projected end portion 67*b* instead of the protrusions 67*f*. In addition, the stepped portions may be formed on a cutoff portion 73*a* that faces the surface of the projected end portion 67*b* on which the protrusions 67*f* of FIG. 5 are formed. In other words, the dynamic pressure generation part 93 may be formed on at least one of the following two surfaces: a surface of the projected end portion 67*b* of the rear shroud 67 that faces towards the bearing 79, and a surface of the recessed portion 75 in the inner peripheral surface of the motor-side casing 23 that faces the projected end portion 67*b* in an axial direction.

In the third embodiment configured as above, when the rear shroud 67 is rotated pursuant to the rotation of the impeller 47, a dynamic pressure is generated between the projected end portion 67*b* and the ring-shaped member 73 due to the presence of the leakage preventing protrusions 67*f* formed on the projected end portion 67*b*. Due to the dynamic pressure, the impeller 47 is subject to a force being exerted downwards in FIGS. 1 and 5.

Meanwhile, when liquid is introduced into the upstream-side impeller 45 via the inlet 49 during the operation of the pump 1, an upstream side of the inlet 49 comes into a negative pressure state. Due to this, the impeller 45 is subject to a force being exerted upwards in FIGS. 1 and 5.

Thus, the above-mentioned dynamic pressure functions to offset the effect of the above-mentioned upward force applied to the impeller 45, so that a contact resistance between the impeller 45 and an upper end of the bearing 79 and the bearing plate 85 fixed to the pump-side casing 21 can be reduced.

Therefore, in accordance with the third embodiment, an abrasive amount of contacting surfaces between the bearing 79 and the bearing plate 85 can be reduced. Thus, the impellers 45 and 47 can be rotated at a higher speed, and the efficiency and the lifetime of the pump can be improved.

Further, in accordance with the third embodiment, likewise as in the first embodiment, the projected end portion 67*b* of the rear shroud 67 is covered with the recessed portion 75 of the motor-side casing 23. Hence, a high pressure liquid discharged from the outlet 55 of the downstream-side impeller 47 is suppressed from leaking through the gap S, thereby reducing a leakage loss of liquid.

In the above embodiments of the present invention, an apparatus for cooling the heat generation compartment 5 including electronic components has been illustrated as the fluid supplying apparatus using the pump 1. However, the pump 1 may be used for various kinds of fluid supplying apparatus such as a well pump system, a hot water supplying system, a water drainage pump system, or the like.

Further, in the above embodiments of the present invention, the pump 1 has been described to have two impellers 45 and 47 provided in the axial direction. However, the pump 1 may have only the downstream-side impeller 47 shown in FIG. 1 and not the upstream-side impeller 45. Alternatively, in addition to the downstream-side impeller 47, two or more impellers may be provided on the upstream side of the impeller 47 along the axis in a multi-stage arrangement.

While the invention has been shown and described with respect to the embodiments, it will be understood by those skilled in the art that various changes and modifications may be made without departing from the scope of the invention as defined in the following claims.

What is claimed is:

1. A pump comprising: a rotatable rotor installed in a motor part; and one or more impellers installed in a pump part, capable of being rotated together with the rotor in unison, wherein the rotor and the impellers are accommodated in a motor-side casing and a pump-side casing respectively, and each of the impellers has an inlet at an inner periphery thereof and an outlet at an outer periphery thereof, and wherein a housing including a front shroud and a rear shroud for each of the impellers is arranged at both sides of an axial direction of the impellers, an outer peripheral part of a rear-most shroud being couple to the rotor, and the outer peripheral part is projected outwards beyond a gap between an outer peripheral surface of the rotor and an inner peripheral surface of the motor-side casing, in which the rotor is rotatably accommodated, so that the outer peripheral part covers the gap, wherein the rear-most shroud includes a coupling protrusion having an end portion fixedly attached to an upper end of the rotor.

2. The pump of claim 1, wherein the outer peripheral part is inserted in a recessed portion formed at the inner peripheral surface of the motor-side casing.

3. The pump of claim 2, wherein protrusions protruding in directions facing each other are formed on mutually facing surfaces of the outer peripheral part and the recessed portion, respectively, such that the protrusions are arranged not to overlap with each other in a plane including a rotating axis of the impeller, and wherein a leading end of each protrusion of one side is located closer to a base part of each protrusion of the other side than a leading end of each protrusion of the other side is located.

4. The pump of claim 3, wherein the protrusions of either the outer peripheral part or the recessed portion are two in number and spaced apart from each other in a radial direction of the impeller, and wherein the remaining protrusion other than the two protrusions of either the outer peripheral part or the recessed portion is inserted in a groove formed between the two protrusions of either the outer peripheral part or the recessed portion.

5. The pump of claim 2, wherein the impeller includes a bearing integrated therewith capable of being rotated about a rotating support shaft installed in the casing such that an axial end portion of the bearing is capable of being slidingly rotated with respect to the casing, and wherein a dynamic pressure generation part that generates a dynamic pressure by a rotation of the impeller is formed on at least one of a first surface of the outer peripheral part that faces towards the bearing and a second surface of the recessed portion that faces the first surface in an axial direction.

6. The pump of claim 3, wherein the impeller includes a bearing integrated therewith capable of being rotated about a rotating support shaft installed in the casing such that an axial end portion of the bearing is capable of being slidingly rotated with respect to the casing, and wherein a dynamic pressure generation part that generates a dynamic pressure by a rotation of the impeller is formed on at least one of a first surface of the outer peripheral part that faces towards the bearing and a second surface of the recessed portion that faces the first surface in an axial direction.

7. The pump of claim 4, wherein the impeller includes a bearing integrated therewith capable of being rotated about a rotating support shaft installed in the casing such that an axial end portion of the bearing is capable of being slidingly rotated with respect to the casing, and wherein a dynamic pressure generation part that generates a dynamic pressure by a rotation of the impeller is formed on at least one of a first surface of the outer peripheral part that faces towards the bearing and a second surface of the recessed portion that faces the first surface in an axial direction.

8. The pump of claim 5, wherein the dynamic pressure generation part includes at least one stepped portion that extends in a radial direction of the impeller.

9. The pump of claim 6, wherein the dynamic pressure generation part includes at least one stepped portion that extends in a radial direction of the impeller.

10. The pump of claim 7, wherein the dynamic pressure generation part includes at least one stepped portion that extends in a radial direction of the impeller.

11. A fluid supplying apparatus comprising the pump of claim 1.

12. The fluid supplying apparatus of claim 11, further comprising:

a heat sink for cooling a heat generation compartment by drawing fluid discharged from the pump to the heat generation compartment; and a heat radiator for cooling the fluid whose temperature has been increased by gaining heat from the heat generation compartment at the heat sink, and supplying the cooled fluid into the pump.

* * * * *